US009486039B2

(12) United States Patent
Ha

(10) Patent No.: US 9,486,039 B2
(45) Date of Patent: Nov. 8, 2016

(54) WIRE CLAMPING DEVICE

(71) Applicant: SHINKYUNG INC, Busan (KR)

(72) Inventor: Gi Ho Ha, Busan (KR)

(73) Assignee: SHINKYUNG INC, Busan (KR)

( * ) Notice: Subject to any disclaimer, the term of this patent is extended or adjusted under 35 U.S.C. 154(b) by 0 days.

(21) Appl. No.: 14/649,122

(22) PCT Filed: Dec. 17, 2013

(86) PCT No.: PCT/KR2013/011717
§ 371 (c)(1),
(2) Date: Jun. 2, 2015

(87) PCT Pub. No.: WO2014/098439
PCT Pub. Date: Jun. 26, 2014

(65) Prior Publication Data

US 2015/0313319 A1 Nov. 5, 2015

(30) Foreign Application Priority Data

Dec. 17, 2012 (KR) ..... 10-2012-0147178

(51) Int. Cl.
*A43C 11/16* (2006.01)
*A42B 7/00* (2006.01)
(Continued)

(52) U.S. Cl.
CPC ..... *A43C 11/165* (2013.01); *A42B 1/22* (2013.01); *A42B 7/00* (2013.01); *A43C 11/24* (2013.01); *Y10T 24/32* (2015.01); *Y10T 24/37* (2015.01)

(58) Field of Classification Search
CPC ..... A43C 11/165; A43C 7/00; A43C 11/16; Y10T 24/2183; Y10T 24/2187; Y10T 24/3913
See application file for complete search history.

(56) References Cited

U.S. PATENT DOCUMENTS 3,478,981 A * 11/1969 Barecki ..... B60R 22/38 242/383.3
4,633,599 A * 1/1987 Morell ..... A43C 11/16 24/68 SK (Continued)

FOREIGN PATENT DOCUMENTS

KR 10-0953398 A 4/2010
KR 10-1028468 B1 4/2011

(Continued)

OTHER PUBLICATIONS

International Search Report issued in corresponding PCT/KR2013/011717 on Mar. 27, 2014.

*Primary Examiner* — Robert J Sandy
*Assistant Examiner* — David Upchurch
(74) *Attorney, Agent, or Firm* — Roberts Mlotkowski Safran Cole & Calderon P.C.

(57) ABSTRACT

A wire clamping device that has a simple configuration and is operated in a simple manner so as to improve convenience of use and product productivity and durability including: a housing provided with a ratchet-type gear on the inner circumference thereof and having a cylindrical inner surface; a reel axially coupled to the inside of the housing; an elevating cam having a slide protrusion-formed in the lower portion thereof, an outer circumferential cam groove formed on the outer circumference thereof, and an inner circumferential cam groove formed on the inner circumference thereof; a cam driving unit in which a cam protruding part is formed; a cam base having a guide cam and a ratchet coupling; and a rotating cover coupled to the upper part of the cam driving unit so as to be rotated in an integral manner.

5 Claims, 5 Drawing Sheets

(51) Int. Cl.
*A43C 11/24* (2006.01)
*A42B 1/22* (2006.01)

(56) References Cited

U.S. PATENT DOCUMENTS 5,157,813 A 10/1992 Carroll
7,076,843 B2 7/2006 Sakabayashi
2005/0081339 A1* 4/2005 Sakabayashi ..... A43C 7/00 24/128
2006/0156517 A1* 7/2006 Hammerslag ..... A43B 5/16 24/68 SK
2010/0139057 A1* 6/2010 Soderberg ..... A43C 11/16 24/68 R
2011/0266384 A1* 11/2011 Goodman ..... A43C 11/165 242/396.4
2012/0004587 A1* 1/2012 Nickel ..... A61F 5/0118 602/21
2013/0092780 A1* 4/2013 Soderberg ..... A43C 11/165 242/396.4

FOREIGN PATENT DOCUMENTS

KR 10-1053551 A 8/2011
KR 10-1099458 B1 12/2011

* cited by examiner

WIRE CLAMPING DEVICE

TECHNICAL FIELD

The present invention relates to a wire clamping device, and in particular to a wire clamping device which is able to enhance convenience when in use and productivity and durability of a product since the configuration and operation are simplified.

BACKGROUND ART

Generally speaking, a wire clamping device is being applied for various purposes and is used to clamp items. Here, among various applications to the above wire clamping device, the application where such wire clamping device is used for sneakers on feet will be mainly described, but it is obvious that such a wire clamping device can apply to sneakers as well as various items, for example, a hair decoration item including a cap, a belt, gloves, a bag, a snow boarder, a water ski, etc. which can be worn using a wire.

Meanwhile, shoes, for example, sneakers include laces which are intended to be connected in a zigzag manner so that the shoes can better fit users shoes. The fitting between the shoes and the users feet can be improved when tightening the laces, so the user can walk more comfortably.

Of course, a proper size of shoes should be selected, otherwise the shoes may get off during walking. It is common that the user puts on shoes with the laces being tied a little loose for easier putting on or taking off, but for the health of feet, laces are preferably tighten to the extent that the shoes don't press shoes during walking, thus keeping the shoes from coming loose.

However, it is annoying to tighten or loosen the laces whenever the user puts on and takes off the shoes, so the user uses the shoes with the laces being tied a little loose except for special occasion. In this case, the user must stop walking if the laces are untied to tie the laces again, which cause a lot of troublesome. If both ends of the lace are not fixed even though the laces are not untied, the shoes may look non-neat.

Furthermore, it is not easy for the students of lower grades or kids before school or old men and women to tighten or loosen laces, and athletes or common persons who are climbing up or down mountain and are racing bikes may have poor records or may have accidents if both ends or knots of the unfixed laces are untied due to violent actions when the laces get caught on any external thing, so it is preferred to keep the untying of the laces fixed stably.

In addition, it is most preferred that the laces should be tied easily because it is possible to have enough rest in case where the tightened laces are loosened during resting, and the tightened laces should be kept stably, and the tied laces should be easily loosened.

The developments for a lace tightening device are underway, which provides a function of helping the tightening and untying of the laces the actions of which are reverse.

For example, the typical lace tightening device is implemented in a way of using a ratchet-type gear and is configured so that a rotation member inside having a reel part, around which laces are wound, can be selectively restricted. Here, if the rotation member rotates in one direction, it can be driven to tighten the laces, and if the ratchet gear is released through a stopper, the reel part rotates independently, thus untying the laces.

However, according to the conventional lace tightening device, the laces should be untied in a manner that the stopper is pushed to one side with one hand so as to release the ratchet gear, and then the laces should be untied with the other hand. In this case, since both the hands are inevitably used, it is inconvenient to use, and kids or weak persons, who cannot easily learn how to use, may feel hard when using such a device.

In addition, according to the above lace tightening device, if the stopper is not appropriately pushed to one side, the untying procedure may be stopped, for example, the laces may get caught on something while the laces are being pulled and untied. For this reason, the reliability of products may become bad. In addition, if a separate stopper fixture is further provided so as to fix a state where the stopper is pushed to one side, the whole configuration may be complicated, thus increasing the number of components, while lowering the productivity.

DISCLOSURE OF INVENTION

Technical Problem

Accordingly, an object of the present invention is to provide a wire clamping device which is able to improve convenience when in use thanks the simplified configuration and operation, and productivity and durability of products can be enhanced.

Solution to Problem

In order to resolve the above object, there is provided a wire clamping device including a housing part provided with a ratchet-type gear on the inner circumference thereof and having a cylindrical inner surface; a reel part axially coupled to the inside of the housing part and arranged in a rotatable manner such that a wire is wound, and having a ratchet-type protrusion is formed in the upper portion thereof; an elevating cam part having a slide protrusion, which is coupled in a selectively elevating manner along the ratchet-type protrusion, formed in the lower portion thereof, an outer circumferential cam groove part formed on the outer circumference thereof, and an inner circumferential cam groove part formed on the inner circumference thereof; a cam driving unit in which a cam protruding part, which is coupled to the inner circumferential cam groove part so as to lift the elevating cam part during the unidirectional rotation, is formed; a cam base part having a guide cam part, which is inserted into the outer circumferential cam groove part so as to guide the elevation of the elevating cam part, formed on the inner circumference thereof and having a ratchet coupling part, the unidirectional rotation of which is restricted by the ratchet-type gear, provided on the outer circumference thereof; and a rotating cover coupled to the upper part of the cam driving unit so as to be rotated in an integral manner.

Here, the inner circumferential cam groove part and the cam protruding part are obliquely formed to ascend when it rotates in one direction so that the elevating cam part ascends and the ratchet-type protrusion of the reel part separates from the slide protrusion when the cam driving unit rotates in the one direction, and the outer circumferential cam groove part and the guide cam part are obliquely formed in the direction opposite to the slanted directions of the inner circumferential cam groove part and the cam protruding part.

In addition, the ratchet-type protrusion is formed of a plurality of protrusions each having a slanted surface ascending in one direction along the circumferential direction on the upper surface of the reel part, and the slide protrusion is formed, shape-matching with the ratchet-type protrusion, and the one direction rotation of the reel part is restricted by contacting with the vertical surface, and the rotation in the other direction slides along the slanted surface and separates.

In addition, an outer circumferential unit which is spaced apart from the ratchet coupling part to the outside and is arranged rotatable, covering the rim of the top of the housing part is connected to an outer circumference of the cam base part, and a stopper groove part open at a set rotation angle is formed at the outer circumferential unit, and a stopper protrusion which is inserted in the stopper groove part and restricts the rotation angle is formed at an inner circumference of the rotating cover.

Meanwhile, the rotating cover includes a magnetic engaging unit, and a logo mark made of a ferromagnetic metal is selectively attached to or detached from an outer surface of the top of the rotating cover.

Effects of the Invention

The wire clamping device of the present invention can provide the following effects thanks to the above solutions.

First, the wire clamping device can tighten or release a wire by rotating a rotating cover integrally engaged and attached to the wire in one direction or the other direction, so operation is simple and convenience when in use can be improved, and the tightening and releasing can be accurately set in accordance with the direction of rotations, so any inconvenience possibly caused due to errors during operation can be removed, and reliability of product can be improved.

Second, in the wire clamping device, since a slide protrusion and a ratchet-type protrusion of a reel part can be disengaged or engaged based on the ascending and descending of an elevating cam part in accordance with the direction of rotations of the rotating cover, so the reel part can be selectively restricted, whereby the convenience when in use can be greatly improved since the reel part can escape from the elevating cam part and rotate independently, thus pulling and releasing the wire with the help of rotations in one direction or the other direction without operating the rotating cover upward or downward.

Third, since the stopper protrusion of the rotating cover is restricted by a stopper groove part of the cam base part, when torque from the user, which exceeds rotation angle necessary for the engagement or disengagement of the reel part, is over transferred, the internal components can be protected from being broken, so durability of product can be improved.

Fourth, the wire clamping device is equipped with a magnetic engaging unit which is able to easily attach or detach a ferromagnetism logo mark using magnetic force, so it is possible to easily attach or detach a logo mark that a user or a manufacturer prefers. Aesthetic efficiency in terms of the design of a product and an advertisement effect can be obtained.

BEST MODE FOR CARRYING OUT THE INVENTION

The best mode of the present invention will be given below in detail with reference to the accompanying drawings

MODES FOR CARRYING OUT THE INVENTION

The wire clamping device according to a preferred embodiment of the present invention is described below referring to the accompanying drawings.

Figure 1A:
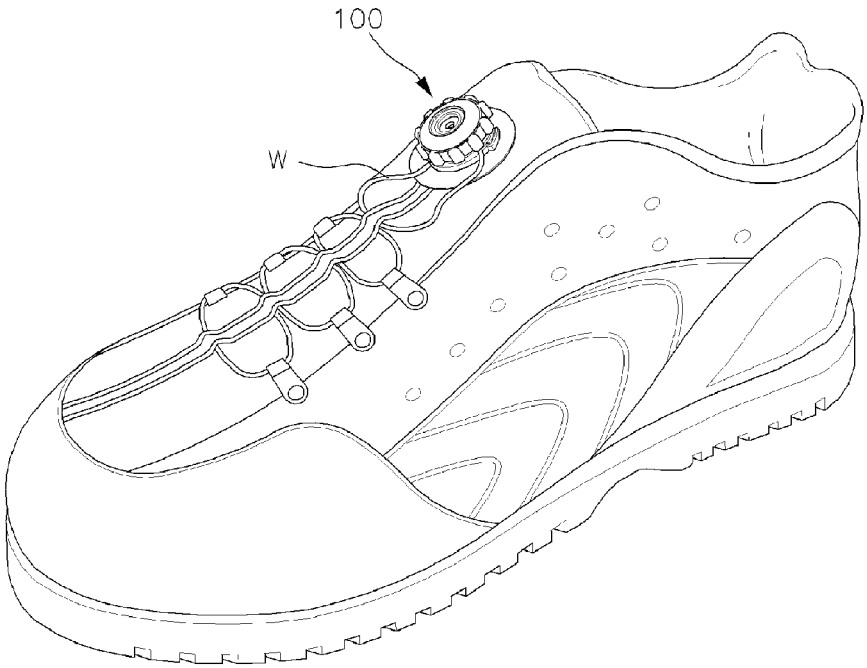
FIG. 1A is a perspective view depicting a shoe to which a wire clamping device has applied according to an embodiment of the present invention.
Figure 1B:
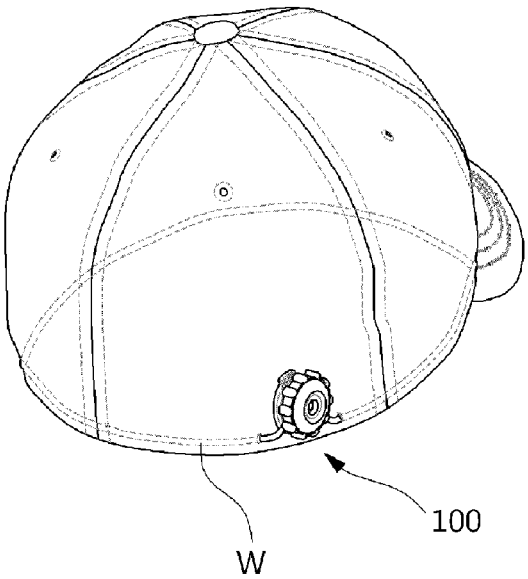
FIG. 1B is a perspective view depicting a cap to which a wire clamping device has applied according to an embodiment of the present invention.

FIG. 1A is a perspective view depicting a shoe to which a wire clamping device has applied according to an embodiment of the present invention. FIG. 1B is a perspective view depicting a cap to which a wire clamping device has applied according to an embodiment of the present invention. Here, the wire clamping device 100 may apply to a device installed at shoes or a cap to help wearing as well as a tightening device which can be variously used for an item, for example, clothes, accessories, exercise tools, etc. which can be worn by tightening a wire or a string as in a belt, gloves, a bag, a water ski, a snow board, etc.

As depicted in FIGS. 1A to 1B, the wire clamping device 100 can be used so as to tighten a wire "w" of shoes or a cap. In case of shoes, it is preferred that the wire clamping device 100 is attached to an upper surface of a tongue portion to which the wire "w" is secured. It may be attached to a side portion of the shoe in consideration of design, etc.

At this time, as the rotating cover of the wire clamping device 100 rotates, the wire "w" can be wound and tightened. For this reason, the wire clamping device 100 can appropriately tighten the wire "w" with respect to the size including the width and height of the users foot, so the user can walk comfortably.

Furthermore, in case of the cap, it can be attached to a side surface to which the wire "w" is connected. It may be attached to a rear side of the cap in consideration of convenience when in use and improvements in terms of design. In addition, in case where it applies to a cap for mountain climbing or a helmet for military, it may be attached to a wire sagging below a users jaw.

As mentioned earlier, the wire can be appropriately tightened with respect to the size including a hear surrounding of a user and the length from top to bottom, which may consequently lead to stable wearing. Therefore, it is possible to prevent any blocking of users view and any interference with a users activity if a cap gets off or is put on twisted due to an environmental reason, for example, rain or wind or an external force during the users activity.

Figure 2A:
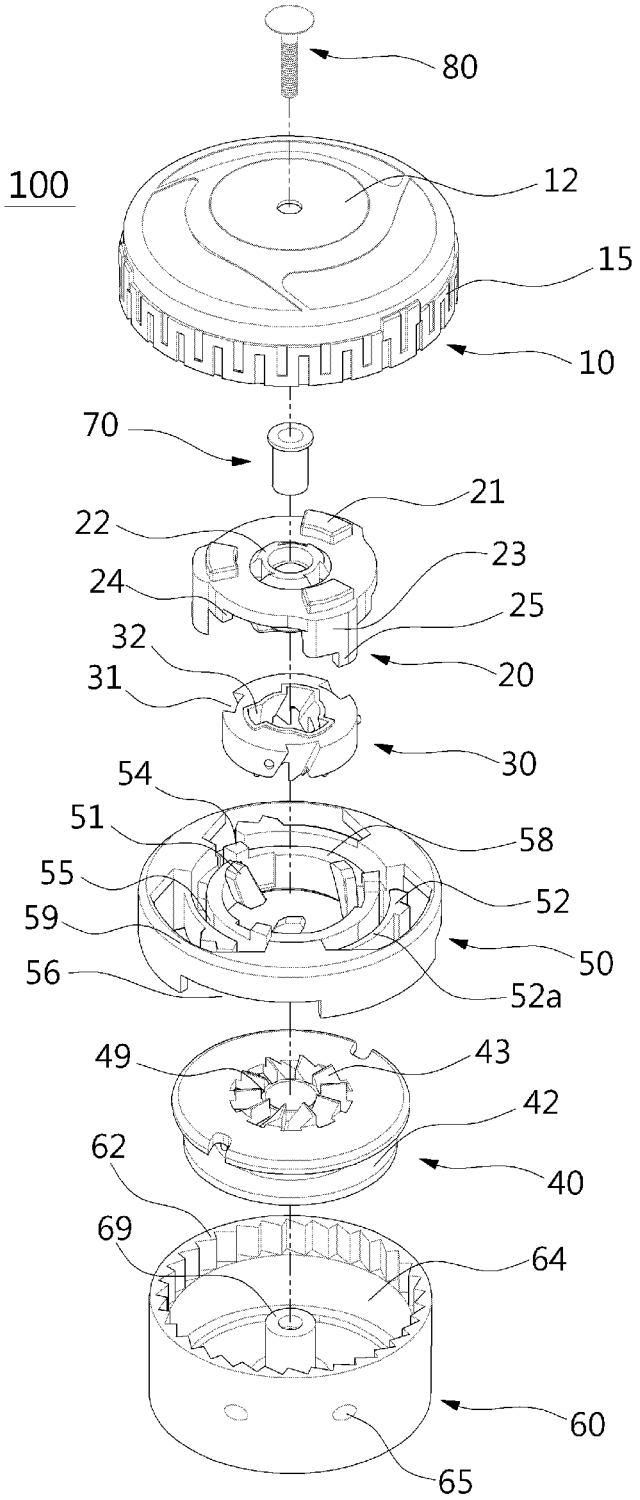
FIG. 2A is a disassembled perspective view when viewing in the upward direction a wire clamping device according to an embodiment of the present invention.
Figure 2B:
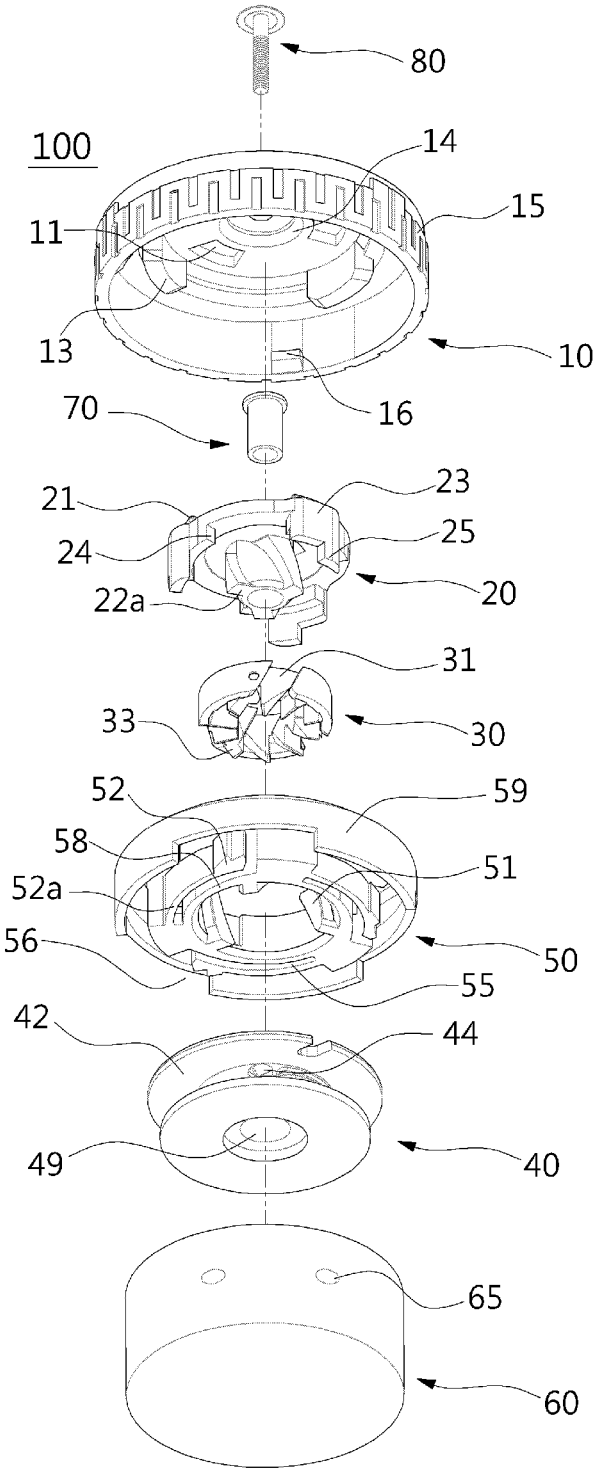
FIG. 2B is a disassembled perspective view when viewing in the downward direction a wire clamping device according to an embodiment of the present invention.
Figure 3:
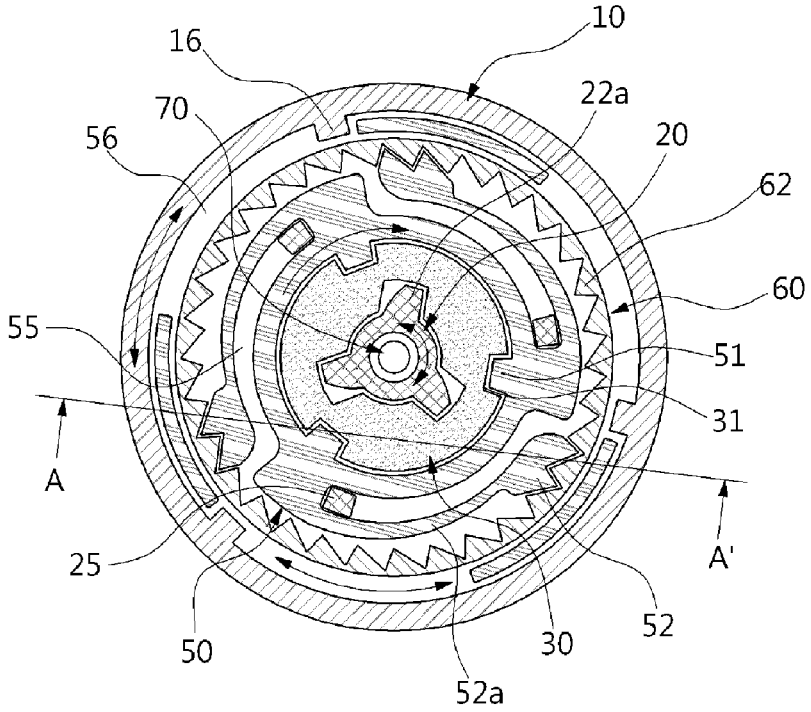
FIG. 3 is a vertical cross sectional view depicting an engaged configuration of a wire clamping device according to an embodiment of the present invention.

FIG. 2A is a disassembled perspective view when viewing in the upward direction a wire clamping device according to an embodiment of the present invention. FIG. 2B is a disassembled perspective view when viewing in the downward direction a wire clamping device according to an embodiment of the present invention. FIG. 3 is a vertical cross sectional view depicting an engaged configuration of a wire clamping device according to an embodiment of the present invention.

As depicted in FIGS. 2A to 2B, the wire clamping device 100 may include a housing part 60, a reel part 40, an elevating cam part 30, a cam driving unit 20, a cam base part 50, a rotating cover 10, a rotary shaft 70 and an engaging screw 80.

Here, a ratchet-type gear 62 is provided at an upper side of an inner circumferential surface of the housing part 60. A lower surface of the housing part 60 is fixed at an outer skin of a shoe. The housing part 60 may have a cylindrical inner space for accommodating the reel part 40 The cam base part 50 is provided at a rim of the top of the housing part 60.

At this time, the cam base part 50 is connected rotatable to a rim of the top of the housing part 60, however it is preferred that the rotation in the counterclockwise direction is restricted by the ratchet-type gear 62.

In addition, the elevating cam part 30 is accommodated in the inner circumference of the cam base part 50. Here, the elevating cam part 30 ascends and descend in the rotation direction of the cam driving unit 20, thus selectively engaging with the upper surface of the reel part 40. In addition, the cam driving unit 20 may be provided at the top of the cam base part 50, but it is preferred that a protrusion unit is formed at the driving unit 20 and is engaged to an inner circumference of the elevating cam part 30.

Furthermore, the rotating cover 10 is engaged to the top of the cam driving unit 20 and rotates integrally, and it is preferred that the rim of a lower side of the rotating cover 10 is engaged to the cam base part 50.

At this time, the engaging screw 80 is engaged through the rotating cover 10 and the rotary shaft 70 and to the housing part 60. In addition, the rotary shaft 70 passes through the reel part 40, the cam base part 50, the elevating cam part 30 and the cam driving unit and is arranged like surrounding the engaging screw 80.

Therefore, the engaged configuration of the internal components forming the wire clamping device 100 can be maintained through the engaging screw 80. In addition, the rotary shaft 70 plays a role of a bearing between the components and the engaging screw 80, so the internal components can be supported rotatable, while preventing abrasion and improving durability.

In addition, in the wire clamping device 100, when the rotating cover 10 rotates in the clockwise direction, the elevating cam part 30 descends and is engaged with the reel part 40 and rotates integrally and drives to wind the wire "w". When it rotates in the counterclockwise direction, the elevating cam part 30 ascends, and the reel part 40 rotates independently, thus pulling and releasing the wire "w".

Of course, the rotation direction of the rotating cover for driving the wire to be wound is not limited to the clockwise direction. The rotation direction may be set to the opposite direction by changing the configuration of the wire clamping device.

Meanwhile, the housing part 60 accommodates the ratchet-type gear 62, a rotary shaft engaging unit 69, a wire passing hole 65, and a reel engaging unit 64. At this time, in order for the user to efficiently apply rotational force to the rotating cover 10, it is preferred that the lower surface of the housing part 60 is fixed at a portion where the wire clamping device is engaged, for example, at an outer skin of a shoe or a tightening portion of a cap.

In addition, the housing part 6 is formed cylindrical, and a wire passing hole 65 is formed at a lower side thereof for the wire to pass. In the inside of the lower side of the housing part 60, the reel engaging unit 64 is formed so that the reel part 40 is engaged and can rotate. It is preferred that the reel engaging unit 64 is formed in a form of a cylindrical space for preventing any friction due to the rotations of the reel part.

Furthermore, the ratchet-type gear 62 is provided at an inner circumference of the rim of the top of the housing part 60 and is engaged rotatable to the outer circumference unit 59 of the cam base part 50 and limits the rotations in the counterclockwise direction of the cam base part 50.

For this reason, in the housing part 60, the rotations in the counterclockwise direction can be limited when a state for pulling and releasing the wire as the user rotates in the counterclockwise direction the rotating cover 10 of the wire clamping device 100 is satisfied, so the releasing state of the wire can be noticed. Therefore, it is possible to improve any inconvenience when in use since the inconvenience due to errors during operation can be removed.

In addition, the housing part 60 plays a role of the case wherein the internal components of the wire clamping device 100 can be driven, thus preventing the components from being lost, which makes it possible to enhance the durability of products.

Of course, there may be provided a detachable adhesive member, for example, a double-sided tape, at the lower surface of the housing part 60. For this reason, a fixing force can be improved when fixing at the outer skin of the shoe, so the wire can be wound stably. When the wire is released, the independent rotations of the reel part can be stably supported, so that the convenience when in use of the wire clamping device can be more improved.

Meanwhile, the reel part 40 includes a ratchet-type protrusion 43, a wire winding unit 42, a wire tying hole 44, and a rotary shaft passing hole 49. Here, the reel part 40 is engaged to a lower inner side of the housing part 60 through the rotary shaft and is arranged rotatable. The cam base part 50 is arranged at the top of the reel part 40. Here, it is possible to selectively engage the ratchet-type protrusions 43 formed on the lower side of the elevating cam part 30 engaged to the inner circumference of the cam base part 50 and on the upper surface of the reel part 40.

In addition, it is preferred that the ratchet-type protrusion 43 is formed protruding upward in the counterclockwise direction along a circumference from the upper surface of the reel part and is selectively engaged with a slide protrusion 33 formed at the lower side of the elevating cam part 30. Here, the ratchet-type protrusion 43 and the slide protrusion 33 are engaged or disengaged based on the rotation direction of the cam driving unit 20.

Namely, if the elevating cam part 30 descends as the cam driving unit 20 rotates in the clockwise direction, the vertical surface of the slide protrusion 33 having a slanted surface protruding downward along the circumferential direction and the vertical surface of the ratchet-type protrusion 43 meet each other, so that the torque can be efficiently transferred.

In addition, if the elevating cam part 30 ascends as the cam driving unit 20 rotates in the counterclockwise direction, the slide protrusion 33 can smoothly separate along the slated surface of the ratchet-type protrusion 43.

For this reason, the tightening and releasing states of the wire clamping device 100 can be smoothly changed, thus improving convenience when in use, and flexibility can be provided to the configuration of the wire clamping device 100, thus enhancing durability and improving reliability of products.

In addition, the wire winding unit 42 is formed in a shape of concave grooves along the circumferential direction on the rim surface of the reel part 40 for the wire to be wound. Here, it is preferred that the wire passes through the side portion of the housing part 60 and exposes to the outside, thus tightening or releasing shoes.

At this time, the wire tying hole 44 is formed at the reel part 40. It is preferred that the wire inserted inside through the housing part 60 is wound around the reel part 40 through the wire tying hole 44. For this reason, the wire clamping device 100 can prevent idle rotations of the reel part 40, so the torque can be efficiently transferred, thus enhancing convenience when in use.

Meanwhile, the elevating cam part 30 includes an inner circumferential cam groove part 32, an outer circumferential cam groove part 31, and a slide protrusion 33. Here, the elevating cam part 30 is arranged covering the rotary shaft connection unit 22 formed at the cam driving unit 20 and is engaged to the cam protruding part 22*a* of the cam driving unit 20 through the inner circumferential cam groove part 32. In addition, it is engaged to the guide cam part 51 through the outer circumferential cam groove part 31, but it is preferably arranged inside the cam base part 50 to ascend or descend upward or downward.

At this time, elevating cam part 30 ascends or descends along the rotation direction of the cam driving unit 20, so the slide protrusion 33 formed at the lower surface of the elevating cam part 30 can be selectively engaged with the ratchet-type protrusion 43 formed on the upper surface of the reel part 40.

In addition, the inner circumferential cam groove part 32 is formed covering the outer surface of the cam protruding part 22*a*, but it is preferably formed in the same slanted direction so that it can match with the shape of the external profile of the cam protruding part 22*a* while surrounding the same. In addition, the outer circumferential cam groove part 31 is arranged for the inner surface thereof to engage to the outer surface of the guide cam part 51, but it is preferably formed in the same slanted direction so that it can match with the shape of the external profile of the guide cam part 51.

At this time, the outer circumferential cam groove part 31 and the guide cam part 51 preferably have the slanted types which are opposite to the inner circumferential cam groove part 32 and the cam protruding part 22*a*.

In more detail, the cam protruding part 22*a* is formed in a slanted shape to circumferentially ascend in the clockwise direction along an outer circumferential surface of the rotary shaft connection unit 22, and the inner circumferential cam groove part 32 is formed in a slanted shape to circumferentially ascend in the clockwise direction along an inner circumferential surface of the elevating cam part 30.

In addition, the guide cam part 51 is formed in a slanted shape to circumferentially descend in the clockwise direction along the inner circumferential surface of the cam base part 50, and the outer circumferential cam groove part 31 is formed in a slanted shape to circumferentially descend in the clockwise direction along an outer circumferential surface of the elevating cam part 30.

So, the elevating cam part 30 can move upward or downward since the outer circumferential cam groove part 31 slides based on the guide of the guide cam part 51 by the torque transferred from the cam protruding part 22*a* to the inner circumferential cam groove part 32.

Therefore, the wire clamping device 100 can perform the operations for releasing or tightening the wire by adjusting the engaged state of the elevating cam part 30 and the reel part 40 by using only the rotations in one direction or the other direction. Therefore, the convenience when in use can be improved since inconvenience occurring because it needs to release the wire can be removed with the aid of independent rotations of the reel part by pulling up and down the rotating cover 10.

In addition, the slide protrusion 33 is formed at the lower surface of the elevating cam part 30, and it can be selectively engaged with the ratchet-type protrusion 43 formed on the upper surface of the reel part 40 through the ascending and descending operations of the elevating cam part 30.

Here, the ratchet-type protrusion 43 is made in the form of a plurality of protrusions which each have the slanted surface which rises in the counterclockwise direction along the circumferential direction and are formed on the upper surface of the reel part 40, and the slide protrusion 33 is engaged with the ratchet-type protrusion 43 while matching in shapes. Namely, the slide protrusion 33 has the slanted surface which protrudes downward in the clockwise direction along the circumferential surface and is formed on the lower surface of the elevating cam part 30.

Therefore, if the elevating cam part 30 descends rotating in the clockwise direction, the vertical surface of the slide protrusion 33 contacts with the vertical surface of the ratchet-type protrusion 43, thus efficiently transferring torque from the elevating cam part 30 to the reel part 40, whereas if the elevating cam part 30 ascends rotating in the counterclockwise direction, the slanted surface of the slide protrusion 33 can slide along the slanted surface of the ratchet-type protrusion 43, so the elevating cam part 30 can smoothly separate from the reel part 40.

Therefore, since it is possible to flexibly change the tightening and releasing states of the wire clamping device 100, the convenience when in use can be effectively enhanced. In order to prevent any abrasion when the slide protrusion 33 in the released state separates from the ratchet-type protrusion 43, the present invention allows to enhance the durability of the wire clamping device 100 while improving the reliability of products.

Meanwhile, the cam driving unit 20 includes a restricting protrusion 21, a support member 24, a support protrusion engaging shoulder 23, a pressing protrusion 25, and a rotary shaft connection unit 22 wherein a cam protruding part 22*a* is formed. Here, it is preferred that the cam driving unit 20 is secured to the rotating cover 10 and rotates integrally. At this time, the restricting protrusion 21 formed at the top of the cam driving unit 10 is fixedly inserted in the restricting groove part 11 of the rotating cover 10.

In addition a support protrusion engaging shoulder 23 formed at a rim side of the cam driving unit 20 contacts close with the support protrusion 13 formed at the rotating cover, thus increasing the engaged force between the rotating cover 10 and the cam driving unit 20.

Therefore, the cam driving unit 20 is secured to the rotating cover 10 through the restricting protrusion 21, and the engaged force between the cam driving unit 20 and the rotating cover 10 can increase thanks to the support protrusion engaging shoulder 23. For this, the torque applying through the rotating cover 10 can be effectively transferred to the cam driving unit 20, thus improving the efficiency of the structure of the wire tightening device 100.

In addition, a support member 24 is formed at a lower side of the rim of the cam driving unit 20. Here, the support member 24 supports while allowing the cam base part 50 and the cam driving unit 20 to space apart, thus forming a space wherein the elevating cam part 30 to ascend or descend upward and downward along the cam protruding part 22*a*.

In addition, the support member 24 rotates contacting with the upper surface of the cam base part 50 as the cam driving unit 20 rotates. At over a predetermined angle, it contacts with the support member engaging shoulder 54 formed at the cam base part 50, thus transferring torque.

Here, the above predetermined angle means a rotation angle which defines a state of escaping from the reel part 40 as the elevating cam part 30 ascends by the rotations of the cam driving unit 20 in a state where the elevating cam part 30 and the reel part 40 are engaged.

Namely, the cam driving unit 20 rotates independent from the cam base part 50 within a scope of a predetermined rotation angle, thus allowing the elevating cam part 30 to ascend or descend, and at over the above predetermined rotation angle, it rotates integral with the cam base part 50.

Therefore, the support member 24 and the support member engaging shoulder 54 allow to effectively transfer torque to the cam base part 50 in case where the rotating cover 10 rotates at over a predetermined angle, thus improving convenience when in use and to distribute so that the transferred force does not concentrate on a predetermined portion, thus enhancing reliability by improving the durability of product.

In addition, the pressing protrusion 25 protrudes from a lower side of the rim of the cam driving unit 20 and is inserted in the slide groove part 55 arranged between the inner circumference of the cam base part 50 and the wing unit 52*a* of the ratchet coupling part and rotates, thus allowing the wing unit 52*a* to slide. As it slide-contacts and presses, the wing unit 52*a* of the ratchet coupling part 52 can be selectively and elastically deformed.

Namely, since the pressing protrusion 25 is inserted in the slide groove part 55 of the cam base part 50 and slides based on the rotation of the cam driving unit 20, the wing unit 52*a* can be selectively pressed and elastically deformed based on the position where the pressing protrusion 25 has slid. Therefore, the ratchet coupling part 52 can be elastically supported by the ratchet-type gear 62 thanks to the elastic deformation of the wing unit 52*a*.

In addition, the rotary shaft connection unit 22 is formed at the inner side of the cam driving unit 20 and is formed in a cylindrical shape which protrudes downward. Here, the rotary shaft 70 supported by the rotating cover unit 10 passes through the inner circumference of the rotary shaft connection unit 22.

At this time, it is preferred that the cam protruding part 22*a* formed in the slanted type is formed at the outer circumference of the rotary shaft connection unit 22 so that it can circumferentially ascend in the clockwise direction along an outer circumferential surface. In addition, the cam protruding part 22*a* includes an elevating cam part 30 which can ascend and descend sliding along the slanted surface of the cam protruding part 22*a* when the cam driving unit 20 rotates.

Of course, the inner circumferential cam groove part 32 and the cam protruding part 22*a* are obliquely formed to ascend when it rotates in the clockwise direction, and the formed slanted surface may be formed in a spiral screw shape at a predetermined inclination.

So, the cam protruding part 22*a* and the inner circumferential cam groove part 32 are engaged in a slide contact way, so force can be efficiently transferred when the cam protruding part 22*a* slides in the inner circumferential cam groove part 32 and slides out, thus preventing any abrasion due to friction, so it is possible to enhance convenience when in use and durability of products.

Meanwhile, the cam base part 50 includes a guide cam part 51, a support member engaging shoulder 54, a slide groove part 55, an inner circumferential unit 58 at which the ratchet coupling part 52 is formed, and an outer circumferential unit 59 at which the stopper groove part 56 is formed.

Here, the outer circumferential unit 59 is arranged rotatable in such a way to cover the rim of the top of the housing part 60, and the inner circumferential unit 58 is arranged covering the elevating cam part 30. At this time, the outer circumferential unit 59 and the inner circumferential unit 58 may be injection-molded, and it is preferred that they are integrally connected during the injection molding.

In addition, it is preferred that in the cam base part 50, the ratchet coupling part 52 is formed at the wing unit 52*a* which extends along a circumference at the inner circumferential unit 58. Here, the ratchet coupling part 52 is inter-engaged so that the rotation in the counterclockwise direction can be restricted by the ratchet-type gear 62. In addition, the ratchet coupling part 52 is connected to the wing unit 52*a*, made of elastic material, which extends by a predetermined length from the inner circumferential unit 58.

Therefore, the wing unit 52*a* elastically supports the ratchet coupling part 52 which is engaged to the ratchet-type gear 62, and the rotations in the counterclockwise direction of the cam base part 50 can be surely restricted, and in case of the rotations in the clockwise direction, the ratchet coupling part 52 can smoothly move along the slanted surface of the ratchet-type gear 62 since the wing unit 52*a* is elastically deformed.

In addition, the elastic deformation of the wing unit 52*a* can be selectively controlled by the pressing protrusion 25 inserted in the slide groove part 55, it is possible to surely restrict the rotations in the counterclockwise direction of the cam base part 50, and the rotations in the clockwise direction can move more smoothly. So, the driving for tightening the wire by rotating the rotating cover in the clockwise direction can be more conveniently performed, which makes it possible to improve convenience when in use.

In addition, the guide cam part 51 is inserted in the outer circumferential cam groove part 31 of the elevating cam part 30, thus guiding the ascending and descending of the elevating cam part 30 based on the rotation direction of the cam driving unit 20.

In addition, the stopper groove part 56 opens at a set rotation angle, and the stopper protrusion 16 inserts and is engaged rotatable at a predetermined angle.

At this time, the stopper groove part 56 is formed so that the stopper protrusion 16 can move in the stopper groove part 56 within a predetermined rotation angle, and at over the predetermined rotation angle, it contacts with both ends of the stopper groove part 56, so that the stopper protrusion 16 can receive torque.

It is preferred that the support member engaging shoulder 54 is formed on the upper surface of the cam base part 50. Here, the support member engaging shoulder 54 allows to integrally rotating the cam base part 50 and the cam driving unit 20 by receiving the torque at over a predetermined angle while the cam driving unit 20 rotates contacting with the upper surface of the cam base part 50.

Therefore, the support member engaging shoulder 54 and the support member 24 allow to distribute and transfer the torque if the rotating cover 10 rotates at over a predetermined rotation angle, together with the stopper protrusion 16 of the rotating cover 10 and the stopper groove part 56 of the cam base part 50.

Therefore, it is possible to prevent the elevating cam part 30, the cam driving unit 20 and the cam base part 50 from wearing out or breaking while the cam driving unit 20 and the cam base part 50 are transferring torque, thus enhancing durability of products, and the reliability of products can be improved by reducing error operations.

In addition, the guide cam part 51 is formed at the inner circumferential unit 58 of the cam base part 50, but is engaged with the outer circumferential groove 31 of the elevating cam part 30, thus guiding the ascending and descending of the elevating cam part 30.

Here, it is preferred that the outer circumferential cam groove part 31 and the guide cam part 51 has the slanted types which are opposite to the inner circumferential scam groove part 32 and the cam protruding part 22*a*. At this time, the cam base part 50 is fixed, and since the guide cam part 51 is formed in the slanted type which is opposite to the cam protruding part 22*a*, the elevating cam part 30 can ascend and descend sliding upward and downward along the guide cam part 51 based on the rotation direction of the cam driving unit 20.

In this way, the wire clamping device 100 can tighten or release the wire by simply rotating the rotating cover 10 in the clockwise direction or the is counterclockwise direction, so the operation is easy, thus consequently enhancing convenience when in use.

Meanwhile, the rotating cover 10 includes a restricting groove part 11, a stopper protrusion 16, a support protrusion 13, a friction protrusion 15, a magnetic engaging unit 12 and a rotary shaft support unit 14. Here, the restricting groove part 11 is formed at a lower surface of the rotating cover 10, and into the restricting groove part 11, a restricting protrusion 21 protruding from the upper side of the cam driving unit 20 is fixedly inserted.

In addition, it is preferred that the support protrusion 13 is formed on a lower surface of the rotating cover 10. At this time, the support protrusion 13 supports the support protrusion engaging shoulder 23 formed at the cam driving unit 20. Therefore, with the support protrusion 13, the rotating cover 10 can fix again the cam driving unit 20 engaged through the restricting groove part 11.

Therefore, the rotating cover 10 supports a side surface of the cam driving unit 20 when it integrally rotates, engaged with the cam driving unit 20, thus restricting the top, which allows to enhance integrity. Since torque can be efficiently transferred with the enhanced integrity, the structural efficiency of the wire clamping device 100 can be improved.

In addition, the friction protrusion 15 is made in a structure wherein a protrusion and a concave groove are alternately formed in the circumferential direction on the outer circumferential surface of the rotating cover 10, and is preferably made of an elastic, extendable material, for example, a synthetic rubber, etc. Therefore, it is possible to enhance friction force and gripping feeling when pressing and rotating the rotating cover 10 with a user's finger.

In addition, the stopper protrusion 16 is formed in a shape of a slanted protrusion at the lower side of the inner circumferential surface of the rotating cover, wherein the protrusion becomes bulky in the direction of the top of the rotating cover 10. Here, the stopper protrusion 16 is inserted in the stopper groove part 56 formed at a lower side of the cam base part 50, thus engaging the rotating cover 10 to the cam base part 50.

At this time, the slanted surface of the protrusion meets the outer circumferential surface of the cam base part 50 and slides, and the vertical angle surface gets caught in the stopper groove part 56, thus obtaining easier assembling and improving the engaged force.

Furthermore, as depicted in FIG. 3, the stopper protrusion 16 is inserted in the stopper groove part 56. Since the stopper groove part 56 is open at a set rotation angle, the rotating cover 10 is engaged, covering the outer circumference of the cam base part 50, and is rotatable at a predetermined angle.

In other words, if torque applies to the rotating cover 10, the stopper protrusion 16 can move inside the stopper groove part 56 and within a set rotation angle. In addition, at over the set rotation angle, the stopper protrusion 16 gets caught at both ends of the stopper groove part 56, thus transferring torque to the cam base part 50.

Therefore, the torque which applies to the rotating cover 10 and within the rotation angle doesn't not apply to the cam base part 50, the rotating cover 10 and the cam driving unit 20 can rotate independent from the cam base part 50. At this time, the applying rotations transfer to the cam driving unit 20, thus ascending and descending the elevating cam part 30.

In addition, at over the rotation angle, the torque, which has applied to the rotating cover 10, transfers to the cam driving unit 20 and the cam base part 50, so that the rotating cover 10, the cam driving unit 20 and the cam base part 50 can rotate integrally.

So, the rotation in the counterclockwise direction applies to the rotating cover 10 to cause the reel part 40 to separate from the elevating cam part 30, and when the reel part 40 separates and becomes rotatable independently, the ascending and descending can be restricted to stop. Therefore, the wire clamping device 100 can prevent error operation by accurately setting the tightening state and the releasing state, thus improving convenience when in use, and can prevent any damages to the products by preventing over force from applying to the internal components, so the reliability of products can be improved.

In addition, the top of the rotary shaft 70 is inserted in and engaged to the rotation shaft support unit 14 formed at the lower surface of the rotating cover 10. Here, the rotary shaft 70 passes through the reel part 40, the cam base part, the elevating cam part 30 and the cam driving unit 20 and supports them rotatable. The rotary shaft 20 covers the engaging screw 80 which passes through the rotating cover 10 and is engaged to the housing part 60.

Therefore, since the rotary shaft 70 is fixed to accurately support the rotation movements by which the wire clamping device 100 is driven, the ascending and descending of the elevating cam part performed by the rotations and the selective engagement of the reel part 40 and the elevating cam part 30 can be effectively driven, thus improving convenience when in use and structural efficiency.

Hereinafter, the ascending and descending operations of the elevating cam part 30 which allow the separation and engagement of the ratchet-type protrusion 43 of the reel part 40 and the slide protrusion 33 of the elevating cam part 30 will be described in more detail.

Figure 4A:
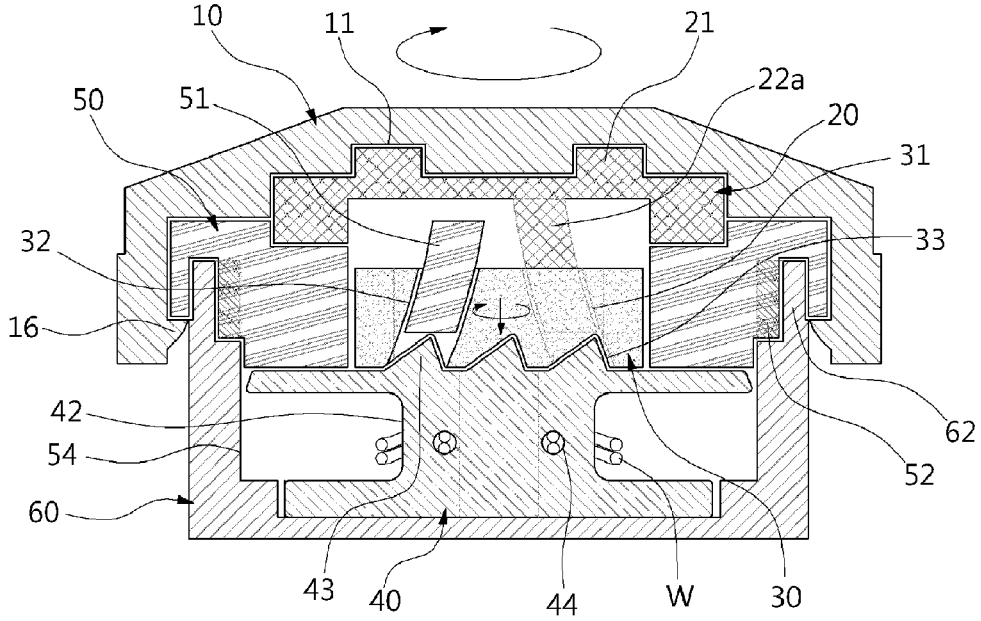
FIGS. 4A and 4B are partially visible cross sectional views when an inner circumferential cam groove part and a cam protruding part are projected on the cross section taken along A-A' in FIG. 3.
Figure 4B:
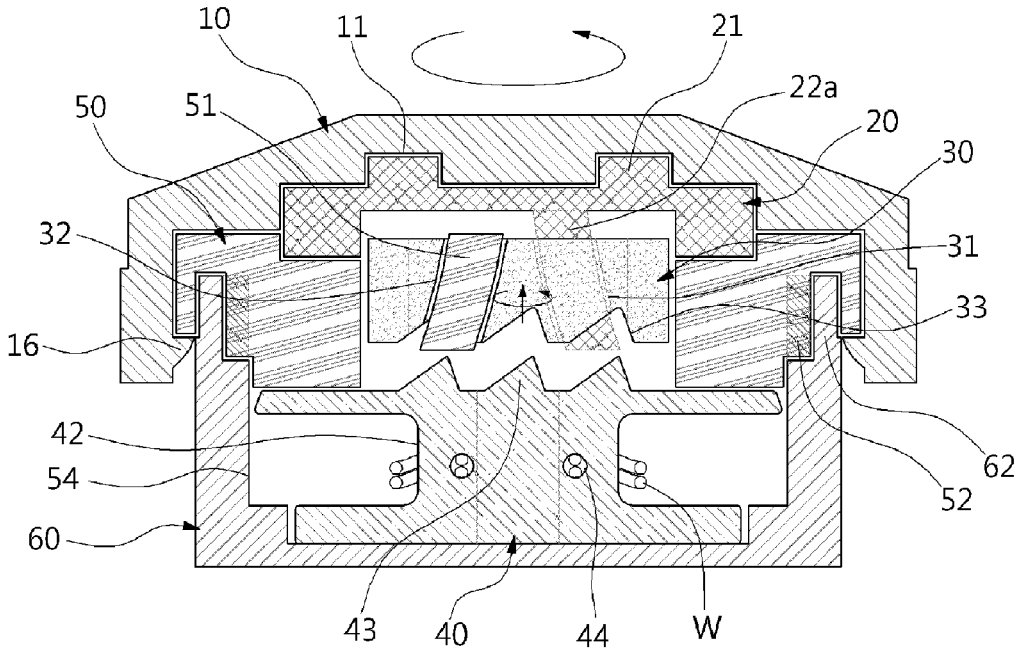

FIGS. 4A and 4B are partial projection cross-sectional views after the inner circumferential cam groove part and the cam protruding part at the rear side are projected on the cross section taken along line A-A' in FIG. 3. Namely, the partial projection cross section view is indicated with a dotted line after projecting the inner circumferential cam groove part 32 at the inner side of the elevating cam part 30 and the cam protruding part 22*a*, which are not depicted in the cross section cut away along the line A-A' in FIG. 3.

As depicted in FIGS. 4A and 4B, in the wire clamping device 100, the elevating cam part 30 can ascend or descend with the rotations of the cam driving unit 20 which occur as the user rotates the rotating cover 10 in one direction or the other direction, so it can be selectively engaged with the reel part 40 in the above structure.

At this time, in case where the elevating cam part 30 descends, the elevating cam part 30 is engaged with the reel part 40 and is driven to rotate integrally, thus winding the wire "w", and in case where the elevating cam part 30 ascends, the reel part 40 separates from the elevating cam part 30 and rotates independently, thus pulling and releasing the wire. In addition, in case where external force from the user is stopped, the reel part 40 can maintain a tightened state with the aid of the cooperation of the elevating cam part 30 and the cam base part 50.

In detail, if the user rotates the rotating cover 10 in the clockwise direction, the torque in the clockwise direction applies to the cam driving unit 20 through the restricting groove part 11 formed at the lower surface of the rotating cover 10.

Here, in case where the rotating cover 10 rotates within the set rotation angle, the stopper protrusion 16 of the rotating cover 10 and the support member 24 of the cam driving unit 20 don't transfer torque to the cam base part 50.

Therefore, when the cam driving unit 20 rotates in the clockwise direction and within the rotation angle, the cam protruding part 22*a* slides and escapes while pushing downward the upwardly slanted surface in the clockwise direction of the inner circumferential cam groove part 32 and rotates at the reduced rotation angle while moving downward the ascending and descending ca unit 30. At this time, the outer circumferential groove 31 slides along the downwardly slanted surface in the clockwise direction of the guide cam part 51, and the elevating cam part 30 can descend.

At this time, the torque applying in the clockwise direction can apply through the transfer path in sequence of the rotating cover 10, the restricting groove part 11, the restricting protrusion 21, the cam driving unit 20, the cam protruding part 22*a*, the inner circumferential cam groove part 32, the elevating cam part 30, and the outer circumferential cam groove part 31.

In addition, the slide protrusion 33 formed on the lower surface of the elevating cam part 30 is engaged with the ratchet-type protrusion 43 formed on the upper surface of the reel part 40.

Here, if the torque continuously applies in the clockwise direction, the torque which has transferred to the rotating cover 10 applies from the stopper protrusion 16 to the stopper groove part 56, and at the same time, the torque which has transferred from the rotating cover 10 to the cam driving unit 20 transfers through the support member 24 to the support member engaging shoulder 54 of the cam base part 50.

Therefore, the rotating cover 10, the cam driving unit 20 and the cam base part 50 rotate integrally, and the elevating cam part 30 can remain engaged with the reel part 40. At this time, the slide protrusion 33 formed on the lower surface of elevating cam part 30 is engaged while shape-matching with the ratchet-type protrusion 43 formed on the upper surface of the reel part 40.

Namely, the ratchet-type protrusion 43 has a slanted surface which upwardly protrudes in the counterclockwise direction along the circumference of the reel part 40, and the slide protrusion 33 has a slanted surface which downwardly protrudes in the clockwise direction along the circumferential direction from the lower surface of the elevating cam part 30. Therefore, the vertical surface of the slide protrusion 33 meets the vertical surface of the ratchet-type protrusion 43, thus efficiently transferring torque.

At this time, the torque which has applied to the rotating cover 10 applies to the reel part 40, and the reel part 40 rotates in the clockwise direction, thus winging the wire "w". In more detail, the transfer path of the torque which has applied to the rotating cover 10 is formed in sequence of the rotating cover 10, the restricting groove part 11, the restricting protrusion 21, and the cam driving unit 20.

At the same time, the torque transfers in sequence of the rotating cover 10, the stopper protrusion 16, the stopper groove part 56, the cam base part 50, and the ratchet coupling part 52. In addition, the torque which has applied to the cam driving unit 20 may be divided into torque which transfers in sequence of the support member 24, the support member engaging shoulder 54, the cam base part 50 and the ratchet coupling part 52, and torque which transfer in sequence of the cam protruding part 22*a*, the inner circumferential cam groove part 32, the elevating cam part 30, the slide protrusion 33, the ratchet-type protrusion 43, and the reel part 40.

In addition, external force applies to the wire "w", for example, in case where the user who carries an item moves or the wire "w" is forcibly pulled, in a state where the supply of the external force from the user has stopped after the wire "w" is wound to the extent that it is appropriately tightened, and then force applies in the releasing direction, torque can apply from the wire "w" to the reel part 40 in the counterclockwise direction.

Here, since the reel part 40 remains engaged with the elevating cam part 30, torque of the reel part 40 applies through the vertical surface of the ratchet-type protrusion 43 and to the vertical surface of the slide protrusion 33, so that the torque in the counterclockwise direction applies to the elevating cam part 30.

At this time, the torque in the counterclockwise direction allows the inner circumferential cam groove part 32 slides down the upwardly slanted surface in the clockwise direction of the cam protruding part 22*a*, however since it contacts already with the reel part 40, it cannot descend. Therefore, the torque in the counterclockwise direction which has applied to the elevating cam part 30 transfers to the guide cam nit 51 by the outer circumferential cam groove part 31.

Here, part of the torque offsets when the force that the outer circumferential cam groove part 31 is intended to ascend against the downwardly slanted surface in the clockwise direction of the guide cam part 51 meets the force that the inner circumferential cam groove part 32 is intended to slide down along the upwardly slanted surface in the clockwise direction of the cam protruding part 22*a*, and part of the torque transfers to the cam base part 50.

At this time, the rotation in the counterclockwise direction of the cam base part 50 is restricted by the housing part 60, the tightened state of the wire "w" can be maintained.

Meanwhile, if the user rotates the rotating cover 10 in the counterclockwise direction, the torque in the counterclockwise direction transfers to the cam driving unit 20 through the restricting groove part 11 formed at the lower surface of the rotating cover 10.

In case where the torque in the counterclockwise direction generates within a predetermined rotation angle, the stopper protrusion 16 of the rotating cover 10 and the support member 24 of the cam driving unit 20 don't transfer torque to the cam base part 50. In addition, the cam base part 50 is fixed in a state where the rotation in the counterclockwise direction is restricted by the housing part 60.

Therefore, the cam protruding part 22*a* slides in downward along the upwardly slanted surface in the clockwise direction of the inner circumferential cam groove part 32, however the elevating cam part 30 rotates at the reduced rotation angle in the counterclockwise direction while moving upward. At this time, the outer circumferential cam groove part 31 slides the upwardly slanted surface in the counterclockwise direction of the guide cam part 51, and the elevating cam part 30 can ascend.

Therefore, the slide protrusion 33 formed at the lower surface of the elevating cam part 30 separates from the ratchet-type protrusion 43 formed on the upper surface of the reel part 40. Here, since the slanted surface of the slide protrusion 33 meets the slanted surface of the ratchet-type protrusion 43 and slides, if the elevating cam part 30 ascends along the rotations in the counterclockwise direction of the cam driving unit 20, it can smoothly separate from the reel part 40.

Since the reel part 40 is rotatable independently without being restricted by the elevating cam part 30, if the user grabs both ends of the wire "w" and pulls the wire "w", the reel part 40 rotates freely and independently, thus easily releasing the wire "w".

At this time, the transfer path of the transferred torque is in sequence of the rotating cover 10, the restricting groove part 11, the restricting protrusion 21, the cam driving unit 20, the cam protruding part 22*a*, the inner circumferential cam groove part 32, the elevating cam part 30 and the outer circumferential cam groove part 31.

Figure 5:
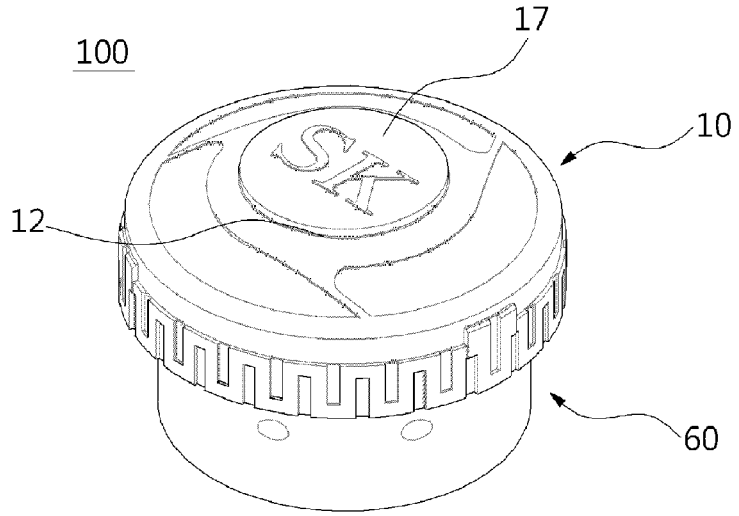
FIG. 5 is a perspective view depicting a configuration wherein a logo mark is attached to a magnetic engaging unit of a wire clamping device according to an embodiment of the present invention.

FIG. 5 is a perspective view depicting a state where the logo mark is attached to the magnetic engaging unit of the wire clamping device according to an embodiment of the present invention.

As depicted in FIG. 5, the magnetic engaging unit 12 can be provided at the rotating cover 10. Here, to the magnetic engaging unit 12, the logo mark 17 made of a ferromagnetic metal can selectively attached. At this time, a picture or a character corresponding to the users personality and preference may be formed on the logo mark 17. It is possible to form a brand mark or a name corresponding to the manufacturer of the item to which the wire clamping device 100 applies.

Therefore, the wire clamping device 100 allows to freely and easily change the logo mark 17 based on the users personality and preference. In addition, the logo mark including the brand mark or the name may be attached to the magnetic engaging unit 12 based on the demand of the manufacturer of the item to which the wire clamping device 100 applies. Therefore, the wire clamping device 100 can improve the design-based efficiency of the product and advertisement effects of the products.

Of course, the logo mark 17 can be formed covering the front side of the rotating cover. Here, the logo mark 17 can be freely attached or detached since it is attached using magnetic force even when the logo mark 17 has a predetermined size or shape which may interfere with the operation of the rotating cover, for which convenience when in use can be maintained while enhancing the design-based efficiency.

As described above, it is noted that the present invention is not limited to the disclosed embodiments. Any modifications are available by those who skilled in the art where the present invention pertains without departing from the scope of the clams of the present invention, and it is obvious that such modifications belong to the scope of the present invention.

INDUSTRIAL APPLICABILITY

The present invention can provide a wire clamping device which is able to improve the convenience when in use and the productivity and durability of products thanks to the simplified configuration and operation, so the present invention can well apply to industry.

The invention claimed is:

1. A wire clamping device, comprising:

a housing part provided with a ratchet-type gear on the inner circumference thereof and having a cylindrical inner surface;

a reel part axially coupled to the inside of the housing part and arranged in a rotatable manner such that a wire is wound, and having a ratchet-type protrusion is formed in the upper portion thereof;

an elevating cam part having a slide protrusion, which is coupled in a selectively elevating manner along the ratchet-type protrusion, formed in the lower portion thereof, an outer circumferential cam groove part formed on the outer circumference thereof, and an inner circumferential cam groove part formed on the inner circumference thereof;

a cam driving unit in which a cam protruding part, which is coupled to the inner circumferential cam groove part so as to lift the elevating cam part during the unidirectional rotation, is formed;

a cam base part having a guide cam part, which is inserted into the outer circumferential cam groove part so as to guide the elevation of the elevating cam part, formed on the inner circumference thereof and having a ratchet coupling part, the unidirectional rotation of which is restricted by the ratchet-type gear, provided on the outer circumference thereof; and a rotating cover coupled to the upper part of the cam driving unit so as to be rotated in an integral manner.

2. The device of claim 1, wherein the inner circumferential cam groove part and the cam protruding part are obliquely formed to ascend when it rotates in one direction so that the elevating cam part ascends and the ratchet-type protrusion of the reel part separates from the slide protrusion when the cam driving unit rotates in the one direction, and the outer circumferential cam groove part and the guide cam part are obliquely formed in the direction opposite to the slanted directions of the inner circumferential cam groove part and the cam protruding part.

3. The device of claim 1, wherein the ratchet-type protrusion is formed of a plurality of protrusions each having a slanted surface ascending in one direction along the circumferential direction on the upper surface of the reel part, and the slide protrusion is formed, shape-matching with the ratchet-type protrusion, and the one direction rotation of the reel part is restricted by contacting with the vertical surface, and the rotation in the other direction slides along the slanted surface and separates.

4. The device of claim 1, wherein an outer circumferential unit which is spaced apart from the ratchet coupling part to the outside and is arranged rotatable, covering the rim of the top of the housing part is connected to an outer circumference of the cam base part, and a stopper groove part open at a set rotation angle is formed at the outer circumferential unit, and a stopper protrusion which is inserted in the stopper groove part and restricts the rotation angle is formed at an inner circumference of the rotating cover.

5. The device of claim 1, wherein the rotating cover includes a magnetic engaging unit, and a logo mark made of a ferromagnetic metal is selectively attached to or detached from an outer surface of the top of the rotating cover.

* * * * *